US009248959B2

(12) United States Patent
Skeid et al.

(10) Patent No.: US 9,248,959 B2
(45) Date of Patent: Feb. 2, 2016

(54) SPILL CONTAINMENT INTERMODAL CONTAINER

(71) Applicants: Eirik Skeid, Oslo (NO); Jonas Dovik, Oslo (NO)

(72) Inventors: Eirik Skeid, Oslo (NO); Jonas Dovik, Oslo (NO)

(73) Assignee: Mobile Shelter Systems AS, Fornebu (NO)

( * ) Notice: Subject to any disclaimer, the term of this patent is extended or adjusted under 35 U.S.C. 154(b) by 106 days.

(21) Appl. No.: 14/061,315

(22) Filed: Oct. 23, 2013

(65) Prior Publication Data

US 2015/0108139 A1 Apr. 23, 2015

(51) Int. Cl.
*B65D 88/38* (2006.01)
*B65D 90/00* (2006.01)
*B65D 90/24* (2006.01)

(52) U.S. Cl.
CPC ..... *B65D 90/00* (2013.01); *B65D 90/0073* (2013.01); *B65D 90/24* (2013.01)

(58) Field of Classification Search
CPC ..... B65D 2519/00338; B65D 2519/00532
USPC ..... 220/4.28, 4.31
See application file for complete search history.

(56) References Cited

U.S. PATENT DOCUMENTS 2,579,655 A * 12/1951 Donald ..... 220/6
2,898,122 A * 8/1959 Beckner ..... 280/28.12
2,928,540 A 3/1960 Cunningham
3,407,926 A 10/1968 Rosser
3,547,258 A 12/1970 Black
3,812,974 A 5/1974 Sylvester
3,850,295 A 11/1974 Black
3,883,026 A * 5/1975 Selz ..... 220/6
3,915,303 A 10/1975 Tatham
3,981,410 A * 9/1976 Schurch ..... 220/6
3,987,915 A 10/1976 Conner
4,150,762 A * 4/1979 Brunette ..... 220/485
4,174,045 A * 11/1979 Heller et al. ..... 220/4.28
4,290,370 A 9/1981 Gallagher
4,295,431 A 10/1981 Stavlo
4,324,172 A * 4/1982 Cazals et al. ..... 99/277.1
4,662,532 A * 5/1987 Anderson et al. ..... 220/7
4,715,508 A * 12/1987 Schurch ..... 220/7
4,735,330 A * 4/1988 Hoss ..... 220/6
5,316,174 A * 5/1994 Schutz ..... 220/571
5,415,311 A * 5/1995 Coogan ..... 220/6
5,452,739 A * 9/1995 Mustee et al. ..... 137/312
5,595,305 A * 1/1997 Hart ..... 206/600

(Continued)

*Primary Examiner* — Fenn Mathew
*Assistant Examiner* — Kevin Castillo
(74) *Attorney, Agent, or Firm* — Michael A. Blake

(57) ABSTRACT

A an intermodal container comprising: a first post; a second post; a third post; a fourth post; a floor drain hole located in one of the posts; an outlet drain hole located in one of the posts; a floor attached to the first, second, third, and fourth posts, the floor comprising: a front floor beam; a first side floor beam; a second side floor beam; a rear floor beam; a floor grating permanently attached to the top surface of at least two of the floor beams; at least one floor plate permanently attached to the bottom sides of the front, first side, second side, and rear floor beams, the beams and at least one floor plate forming a floor container, and the floor drain hole in fluid communication with the floor container, and generally at the same elevation as the interior of the floor container, and the outlet drain hole located at an elevation below the floor drain hole and the floor container, the floor container in fluid communication with the interior of the post with the floor drain hole and also in fluid communication with the interior of the post with the outlet drain hole.

10 Claims, 12 Drawing Sheets

(56) References Cited

U.S. PATENT DOCUMENTS

| | | | | | |
|---|---|---|---|---|---|
| 5,642,834 | A | * | 7/1997 | Shaw et al. | 220/720 |
| 5,718,351 | A | * | 2/1998 | Rude | 220/571 |
| D402,037 | S | * | 12/1998 | Hofstad | D34/38 |
| 6,006,918 | A | * | 12/1999 | Hart | 206/600 |
| 6,044,990 | A | | 4/2000 | Palmeri | |
| 6,164,476 | A | * | 12/2000 | Rene et al. | 220/4.31 |
| 6,170,686 | B1 | * | 1/2001 | Flores | 220/4.33 |
| 6,273,670 | B1 | | 8/2001 | Henson | |
| 6,298,999 | B1 | | 10/2001 | Bellman | |
| 6,422,405 | B1 | | 7/2002 | Haenszel | |
| 6,637,077 | B2 | | 10/2003 | Doty | |
| RE39,444 | E | * | 12/2006 | Rene et al. | 220/4.31 |
| D603,123 | S | * | 10/2009 | Canters et al. | D34/38 |
| 7,637,387 | B1 | * | 12/2009 | Cantolino | 220/571 |
| D609,425 | S | * | 2/2010 | Svedberg | D34/38 |
| 7,987,796 | B2 | * | 8/2011 | Nordstrom et al. | 108/53.3 |
| 8,631,965 | B2 | * | 1/2014 | Leasure | 220/682 |
| 8,905,254 | B2 | * | 12/2014 | Joubert | 220/1.5 |
| 2006/0156694 | A1 | | 7/2006 | Aubin | |
| 2008/0193247 | A1 | * | 8/2008 | Zupancich et al. | 410/92 |
| 2009/0148260 | A1 | | 6/2009 | Leimbach | |

* cited by examiner

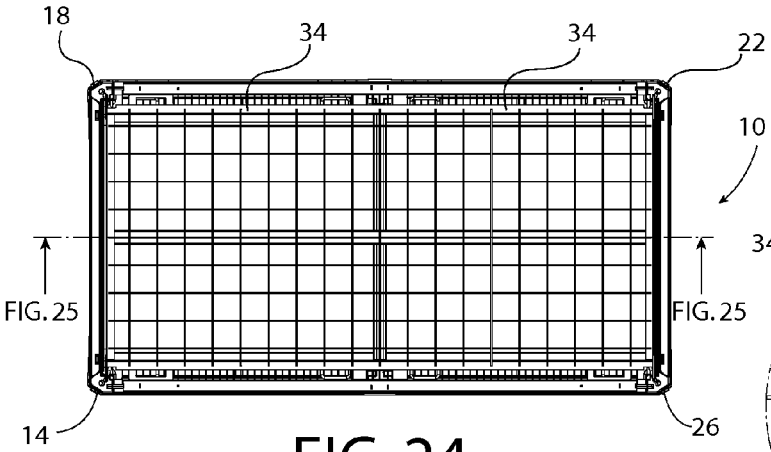
FIG. 24
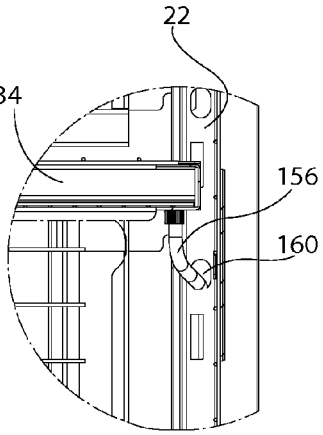
FIG. 26
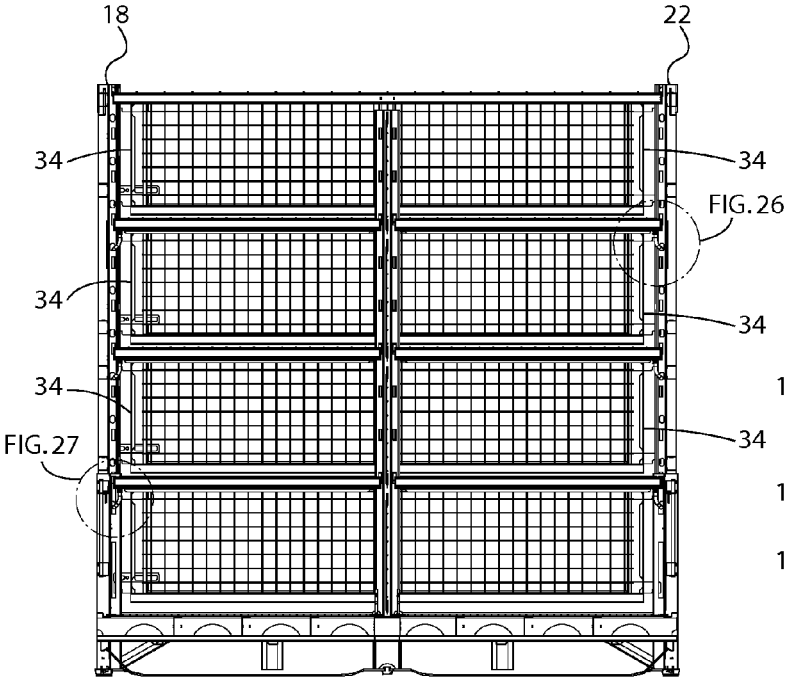
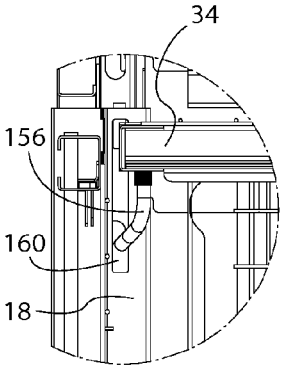
FIG. 27
FIG. 25

SPILL CONTAINMENT INTERMODAL CONTAINER

CROSS-REFERENCES

This patent application is related to patent application Ser. No. 13/735,732, entitled "Intermodal Container", filed on Jan. 7, 2013, the entire contents of which are fully incorporated by reference herein.

TECHNICAL FIELD

The invention relates to intermodal transport containers, and, more particularly, to intermodal transport containers that can contain fluids that leak or spill from items being carried in the containers.

BACKGROUND

There are no known intermodal containers currently used in the transportation industry that can contain fluids that leak from objects being stored in the containers. There are known devices that can used for stationary storage that provides spill containment. However, these devices are not suitable for transportation, they are designed and used for stationary storage. There are known spill containment pallets. However, spill containment pallets have many drawbacks, they are not stackable, and they do not have walls or ceilings to protect the items being carried by the pallets. Spill containment pallets cannot be sling loaded, i.e. carried by helicopter with a sling line and a swivel. In addition, known spill containment pallets are made out of plastic, and plastic pallets will degrade in sunlight, and/or extreme temperatures.

Thus there is a need for an intermodal container that overcomes the above listed and other disadvantages.

SUMMARY OF THE INVENTION

The disclosed invention relates to an intermodal container comprising: a first post; a second post; a third post; a fourth post; a floor drain hole located in one of the posts; an outlet drain hole located in one of the posts; a floor attached to the first, second, third, and fourth posts, the floor comprising: a front floor beam; a first side floor beam; a second side floor beam; a rear floor beam; a floor grating permanently attached to the top surface of at least two of the floor beams; at least one floor plate permanently attached to the bottom sides of the front, first side, second side, and rear floor beams, the beams and at least one floor plate forming a floor container, and the floor drain hole in fluid communication with the floor container, and generally at the same elevation as the interior of the floor container, and the outlet drain hole located at an elevation below the floor drain hole and the floor container, the floor container in fluid communication with the interior of the post with the floor drain hole and also in fluid communication with the interior of the post with the outlet drain hole.

BRIEF DESCRIPTION OF THE DRAWINGS

The present disclosure will be better understood by those skilled in the pertinent art by referencing the accompanying drawings, where like elements are numbered alike in the several figures, in which:

FIG. 24 is a top view of a spill containment intermodal container;

FIG. 25 is a cross-sectional view of the container from FIG. 24;

FIG. 26 is a detail view of a drain hose and post from FIG. 24;

FIG. 27 is a detail view of a different drain hose and post from FIG. 24;

DETAILED DESCRIPTION

Figure 1:
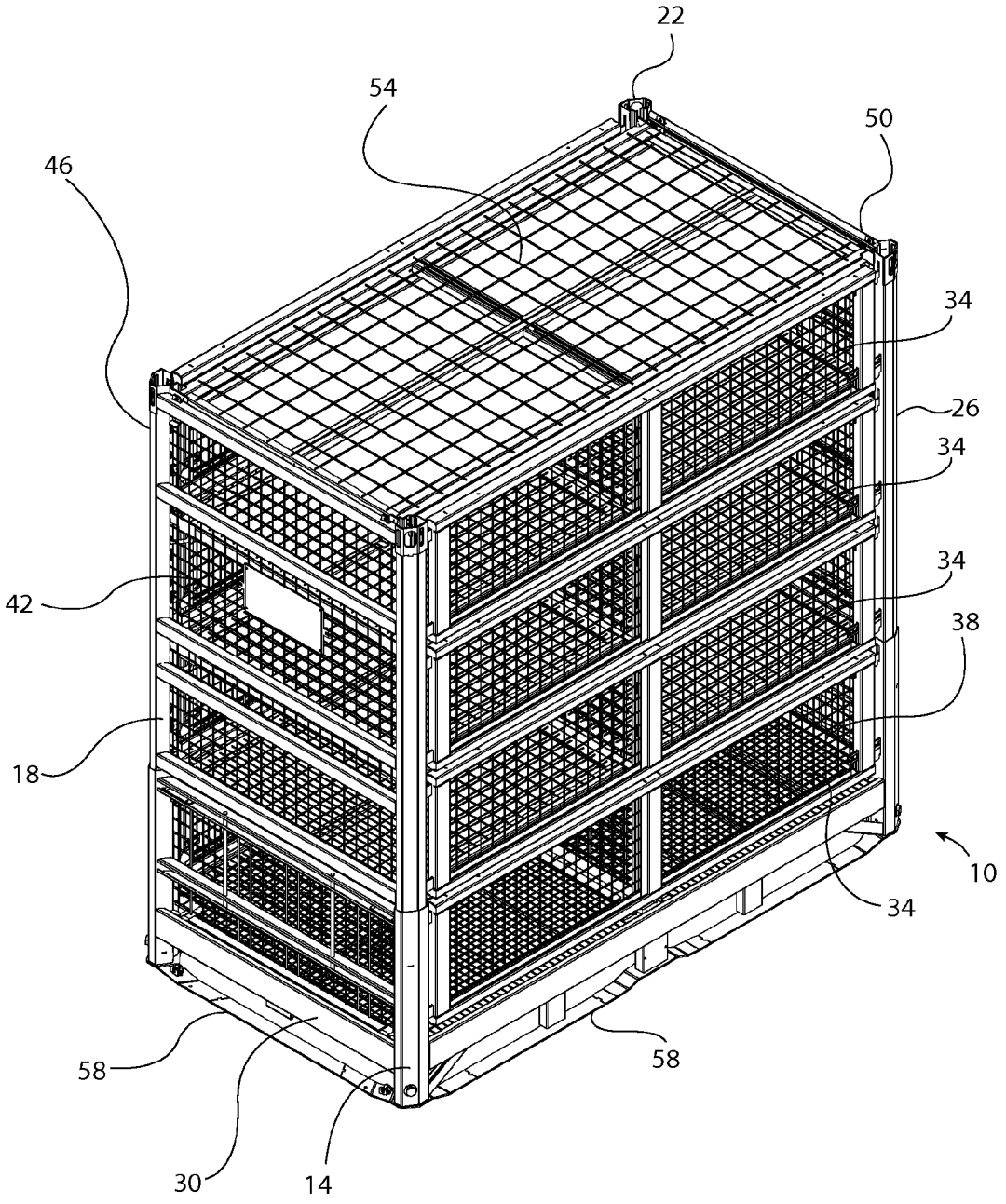
FIG. 1 is a perspective view of the spill containment intermodal container.

FIG. 1 is a perspective view of one embodiment of the disclosed intermodal container 10. The intermodal container comprises four posts 14, 18, 22, 26. Attached to the four posts 14, 18, 22, 26 is a floor 30. Attached to the four posts 14, 18, 22, 26 may be one or more shelves 34. The container 10 may also comprise front walls 38, first side walls 42, rear walls 46, and second side walls 50. The container 10 may also comprise a top shelf 54. The container 10 may also comprise shock dampening supports 58.

Figure 2:
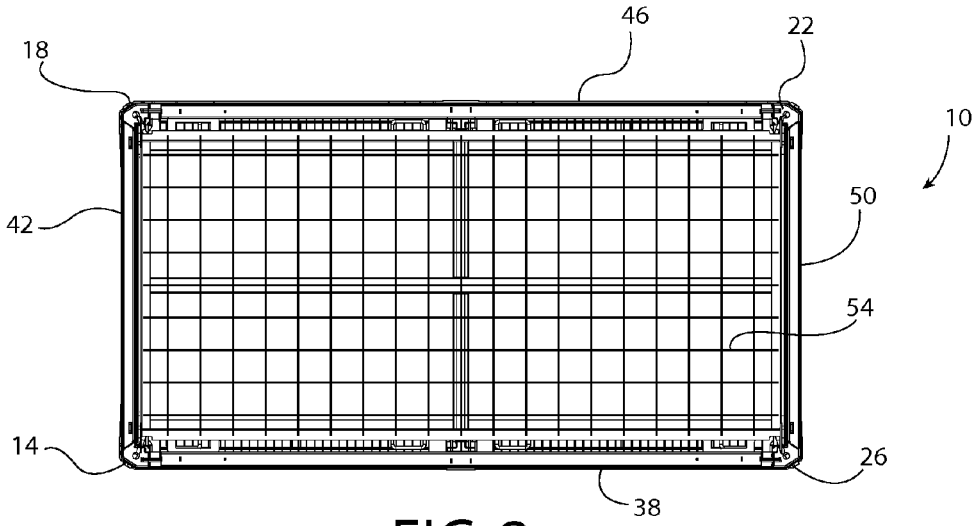
FIG. 2 is a top view of the container from FIG. 1.
Figure 3:
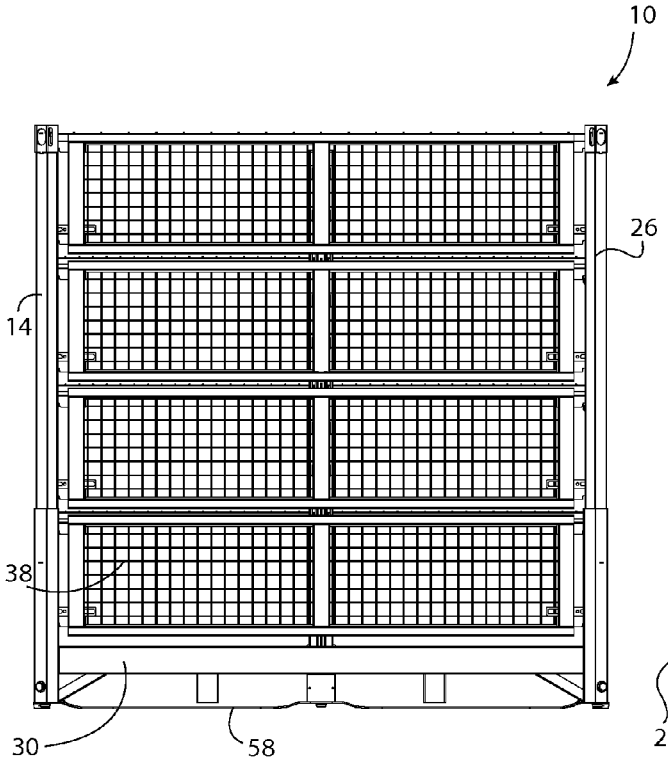
FIG. 3 is a front view of the container from FIG. 1.
Figure 4:
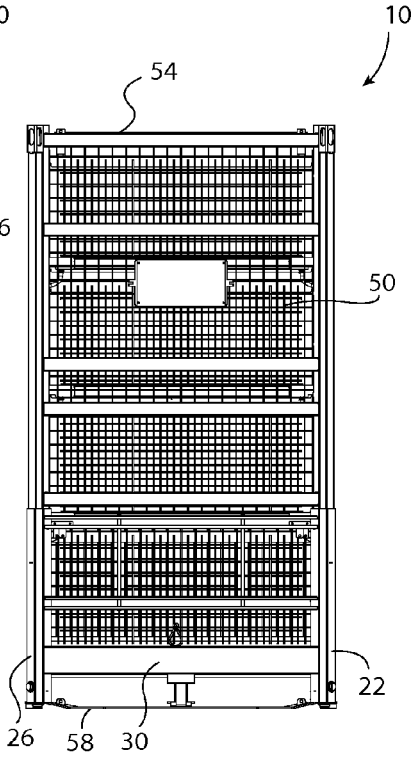
FIG. 4 is a side view of the container from FIG. 1.
Figure 5:
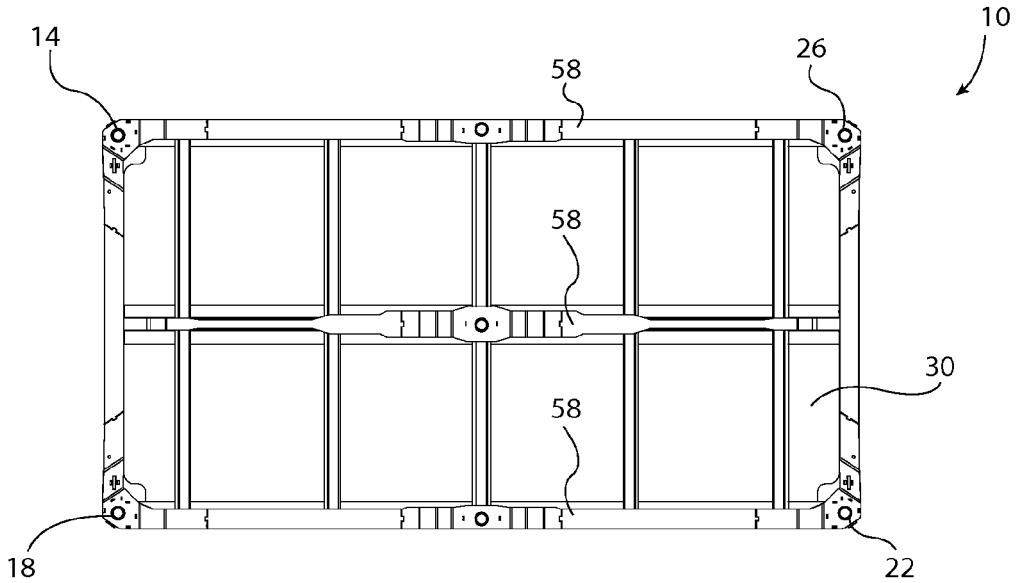
FIG. 5 is a bottom view of the container from FIG. 1.

FIG. 2 is a top view of the intermodal container 10. FIG. 3 is a front view of the container 10. FIG. 4 is a side view of the container 10. FIG. 5 is a bottom view of the container 10.

Figure 6:
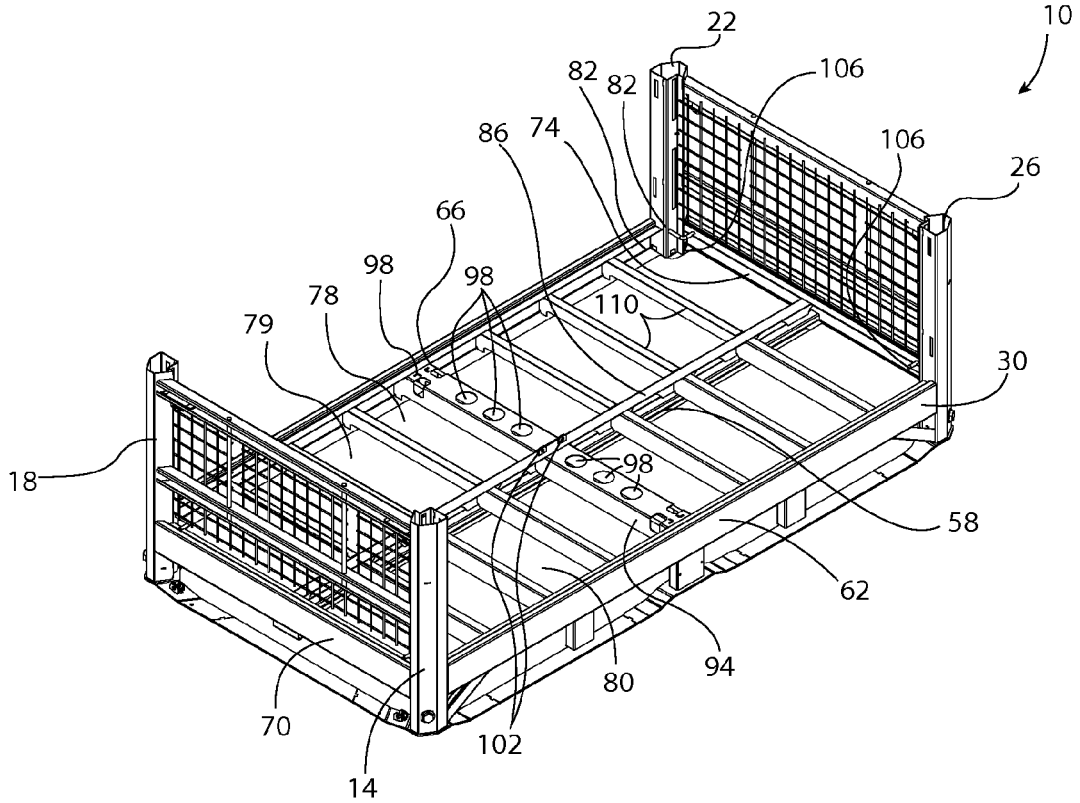
FIG. 6 is a perspective view of the floor of the container.
Figure 17:
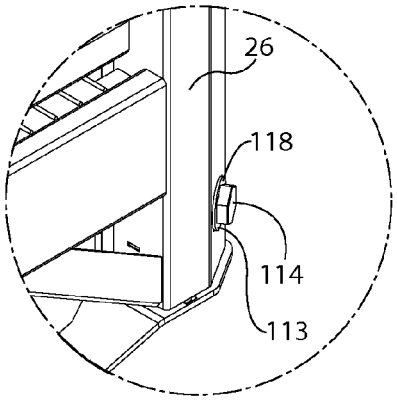
FIG. 17 is a detail view another drain bolt on a different post from FIG. 15.

FIG. 6 is perspective view of the floor 30 of the container 10. The floor comprises a front floor beam 62 attached to posts 14 and 26, a rear floor beam 66 attached to posts 18 and 22, a first side floor beam 70 attached to posts 14 and 18, and a second side floor beam 74 attached to posts 22 and 26. The floor beams 62, 66, 70, 74 are located generally above the bottom of the posts 14, 18, 22, 26. Attached to the bottom of the floor beams 62, 66, 70, 74 is a floor plate 78. The floor plate 78 along with the walls of the floor beams 62, 66, 70, 74 form a floor container that can hold liquids. Floor drain holes 82 are located in at least one of the posts 14, 18, 22, 26. The floor drain holes 82 put the container in fluid communication with the interior of at least one of the posts 14, 18, 22, 26. A floor grating 90 will be located on the floor beams 62, 66, 70, 74 and be located above and adjacent to the floor container. The floor grating 90 is not shown in this view, but is shown in FIG. 17. The floor 30 may also comprise a center beam 86. The bottom of the center beam 86 may have shock dampening support 58. In one embodiment, the floor plate 78 may comprise a first floor plate 79, and a second floor plate 80. Floor plate 79 is on one side of the center beam 86, and floor plate 80 is on the other side of center beam 86. There may also be a midbeam 94, with tie down openings 98 located on the beam. There may be one or more vertical tabs 102 with holes for locating and locking the floor grating 90 in place. There may be tie down bars 106 located in the corners of the floor. The floor 30 may also comprise additional support beams 110 to help carry the load that the floor 30 will carry.

Figure 7:
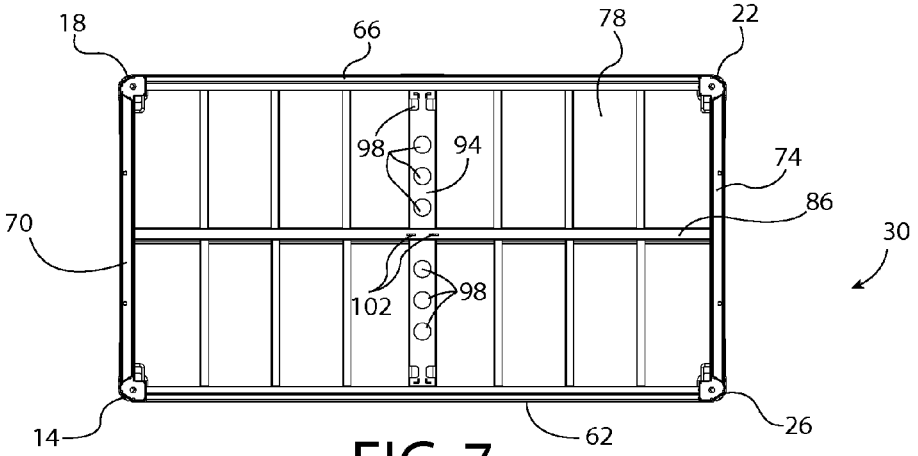
FIG. 7 is a top view of the floor from FIG. 6.
Figure 8:
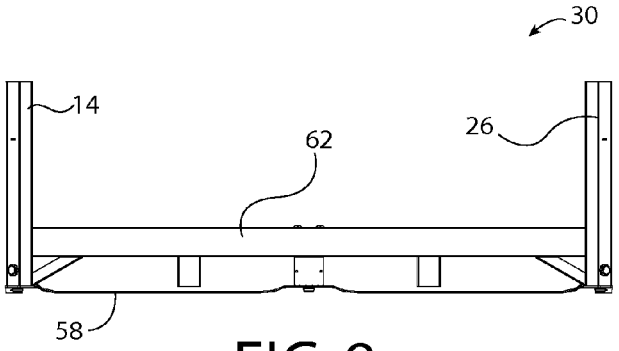
FIG. 8 is a front view of the floor from FIG. 6.
Figure 9:
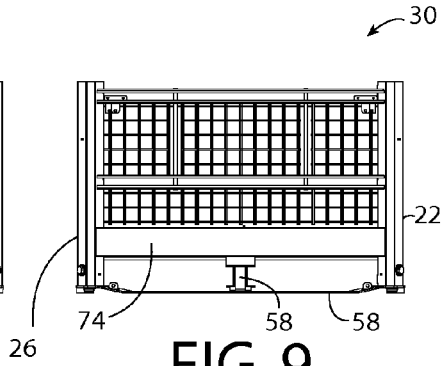
FIG. 9 is a side view of the floor from FIG. 6.
Figure 10:
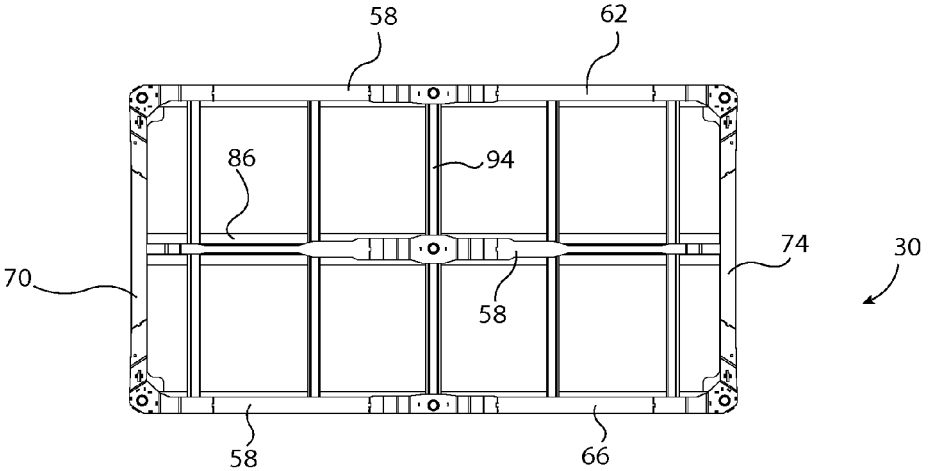
FIG. 10 is a bottom view of the floor from FIG. 6.

FIG. 7 is a top view of the floor 30, with the floor grating 90 removed. FIG. 8 is a front view of the floor 30. FIG. 9 is a side view of the floor 30. FIG. 10 is a bottom view of the floor 30.

Figure 11:
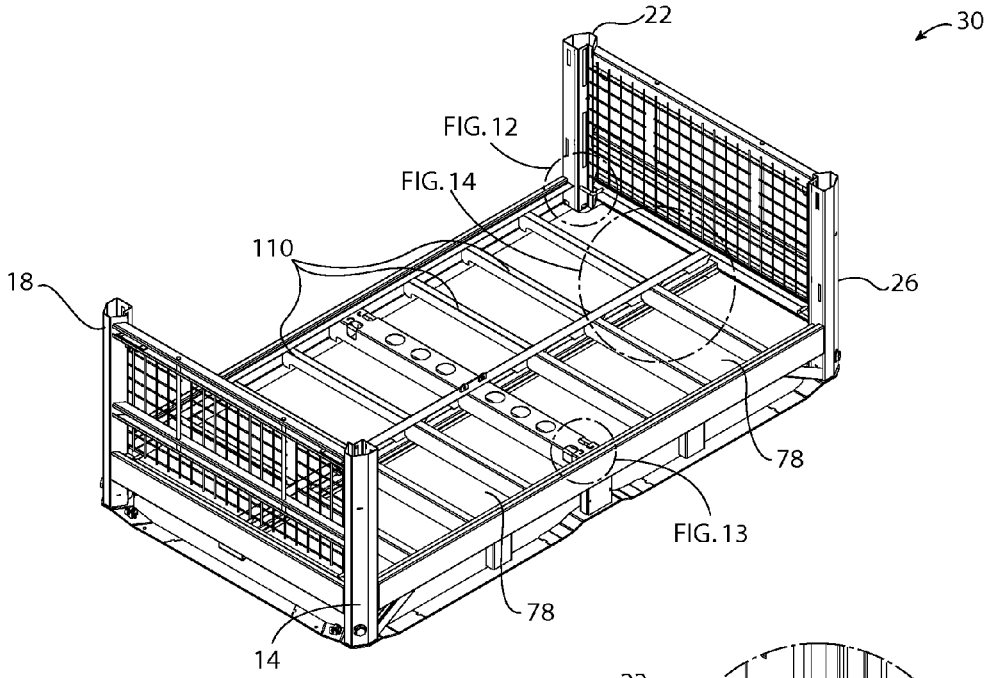
FIG. 11 is a perspective view of the floor of the container.
Figure 12:
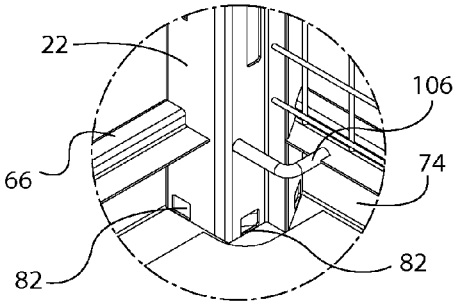
FIG. 12 is a detail view of a post and the floor from FIG. 11.
Figure 13:
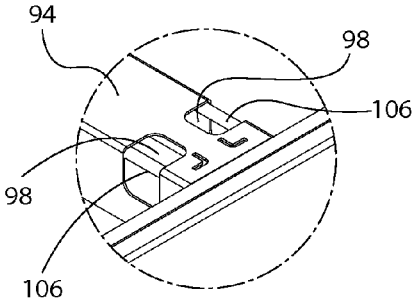
FIG. 13 is a detail view of the midbeam and floor from FIG. 11.
Figure 14:
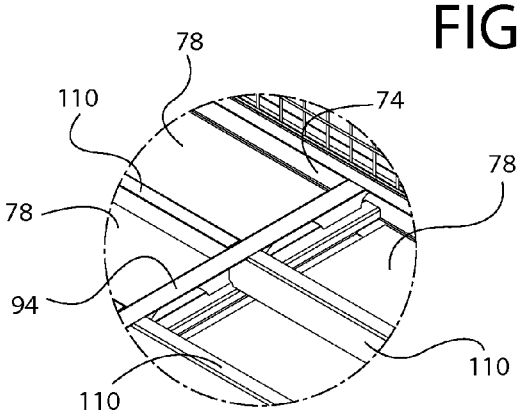
FIG. 14 is a detail view of the center beam and floor from FIG. 11.

FIG. 11 is another perspective view of the floor 30 with certain areas selected for detailed figures. FIG. 12 is a detail view of the post 22. In this view the floor drain holes 82 can be clearly seen, as can the tie down bar 106. FIG. 13 is a detail view of the midbeam 94, showing the tie down opening 98 and a tie down bar 106. FIG. 14 is a detail view of the midbeam 94 and the support beams 110.

The above figures have been described with respect to beams in the floor. However, it should be noted that beams, as described in this disclosure can encompass any structural shape such as a square cross-sectional shape, angled metal (e.g. having an L shaped cross-section), I-beam shaped, channel shaped, etc. The main limitation being, that the front floor beam 62, rear floor beam 66, first side floor beam 70, and second side floor beam 74 have a wall that can form the sides of the floor container, and have a surface for the attachment of the floor plate(s) 78, 79, 80, and a surface for the attachment of a floor grating 90.

Figure 15:
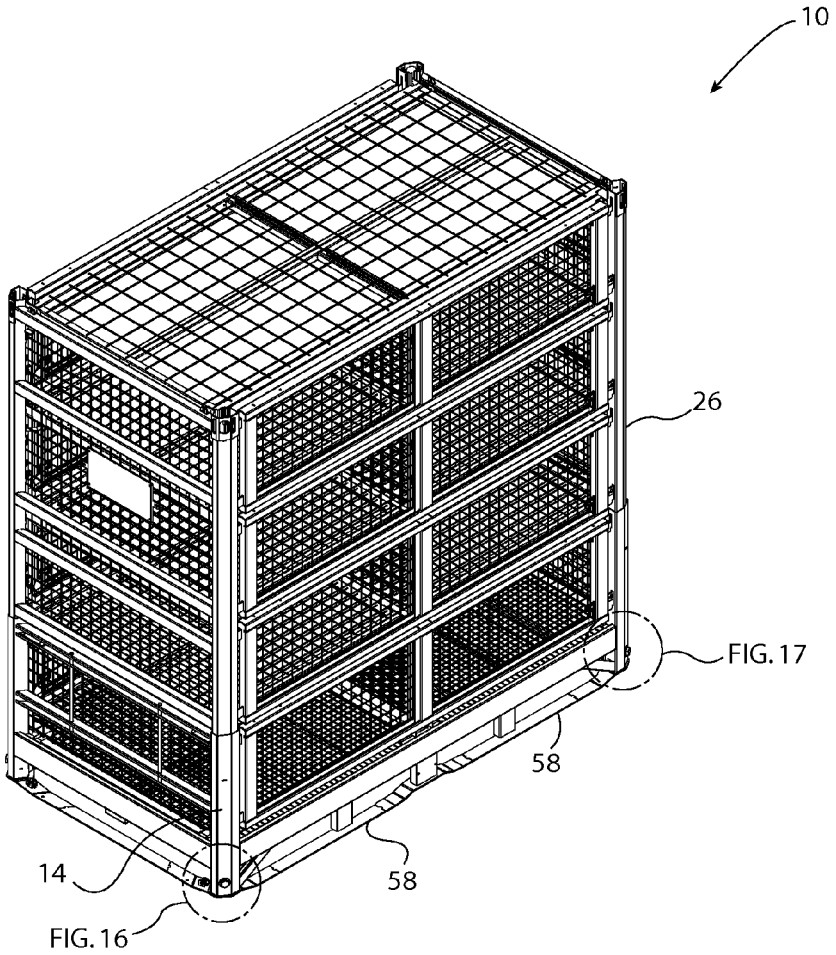
FIG. 15 is a perspective view of the spill containment intermodal container 10.
Figure 16:
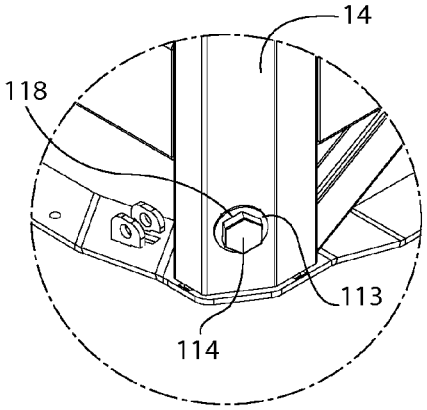
FIG. 16 is a detail view of a drain bolt on a post from FIG. 15.

FIG. 15 is a perspective view of the container 10, with two areas selected for detailed figures. FIG. 16 is a detail view of post 14. In this view an outlet drain hole 113 in the post 14 is plugged with a drain bolt 114 and a drain gasket 118. FIG. 17 is a detail view of post 26, and likewise, an outlet drain hole 113 in post 26 are plugged with a drain bolt 114 and a drain gasket 118. When the outlet drain holes 113 are unplugged, any liquid in the floor container will drain out the outlet drain holes because the floor container is fluid communication with the posts 14, 18, 22, 26 via the floor drain holes 82, and the outlet drain holes 113 are located below the floor container and below the floor drain holes 82.

Figure 18:
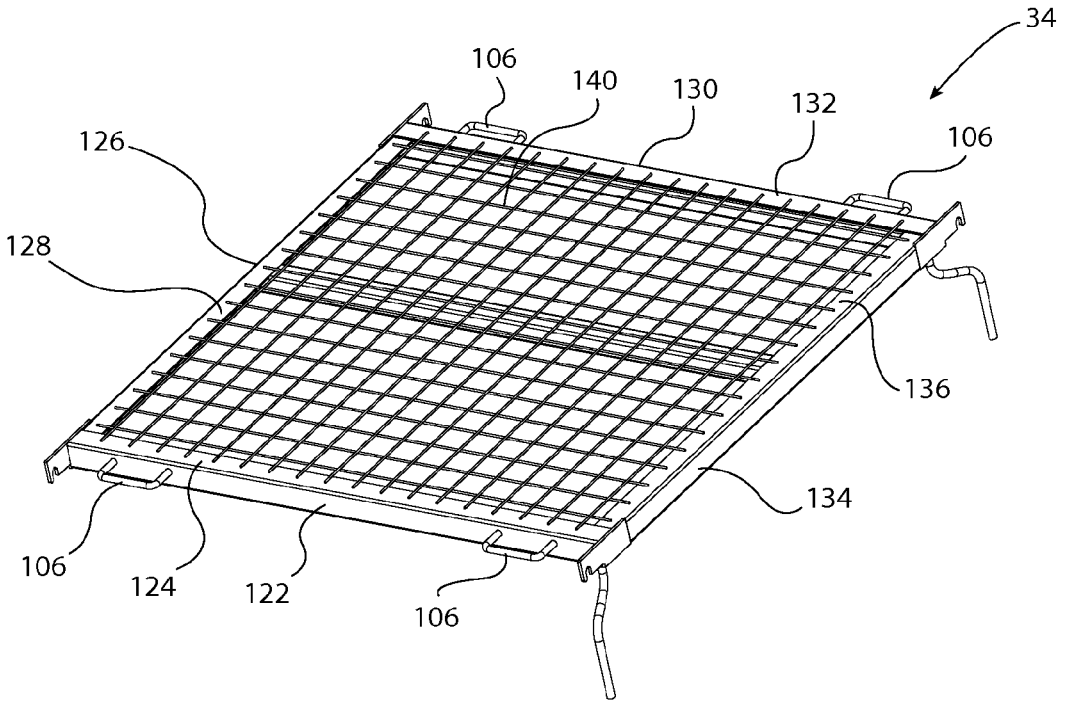
FIG. 18 is a top perspective view of a shelf.
Figure 19:
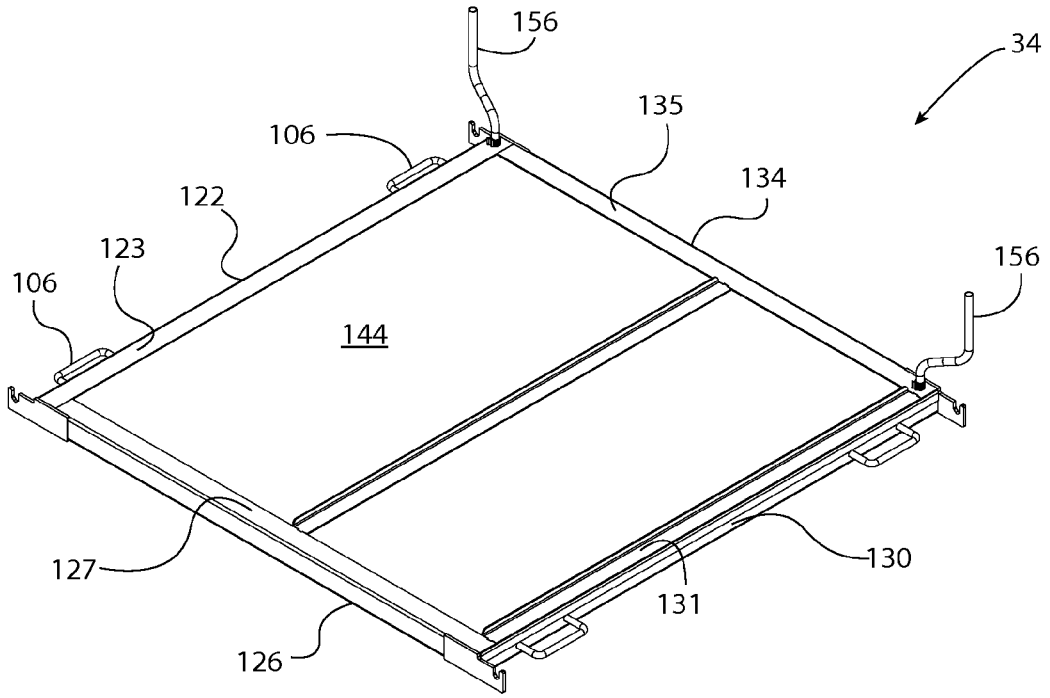
FIG. 19 is a bottom perspective view of the shelf from FIG. 18.

FIG. 18 is a perspective view of a shelf 34. FIG. 19 is a bottom perspective view of the shelf 34 from FIG. 19. The shelf 34 comprises front wall 122, a first side wall 126, a rear wall 130, and a second side wall 134. Each of the walls 122, 126, 130, 134 has a bottom lip, 123, 127,131, and 135 respectively (see FIG. 19). In one optional embodiment, each of the walls 122, 126, 130, 134 may have a top lip 124, 128, 132, 136 respectively. However, the top lips 124, 128, 132, 136 are not required, so long as there is a surface that a shelf grating 140 can attach to. As shown in FIG. 18, a shelf grating is attached to the top lips 124, 128, 132, 136. However, in other embodiments, the shelf grating 140 may be attached to the top surface of the walls 122, 126, 130, 134 if there is no top lip. Thus, in this disclosure, when a shelf grating 140 is attached to a shelf wall, it may mean either the shelf grating 140 is attached to one or more of the top lips 124, 128, 132, 136 or to one or more of the top surface of the walls 122, 126, 130, 134 if there is no top lip. There is a shelf plate 144 attached to the bottom lips 123, 127, 131, and 135. The shelf plate 144, and walls 122, 126, 130, 134 form a shelf container that can hold an amount of liquid. At least one drain pipe is attached to a bottom lip. In this embodiment, there are two drain pipes 168 (see FIGS. 33-34), both of which are attached to drain hoses 156, the drain pipes are located on the underside of lower lips 123, 135. The drain pipes 168 and drain hoses 156 are in fluid communication with the shelf container.

Figure 20:
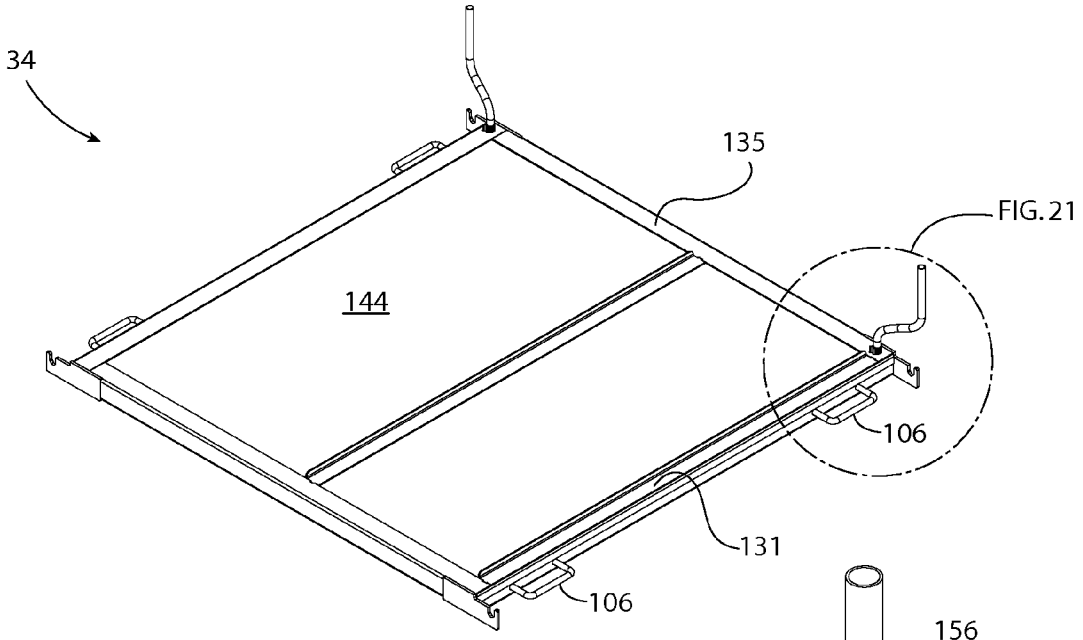
FIG. 20 is a bottom perspective view of a shelf.
Figure 21:
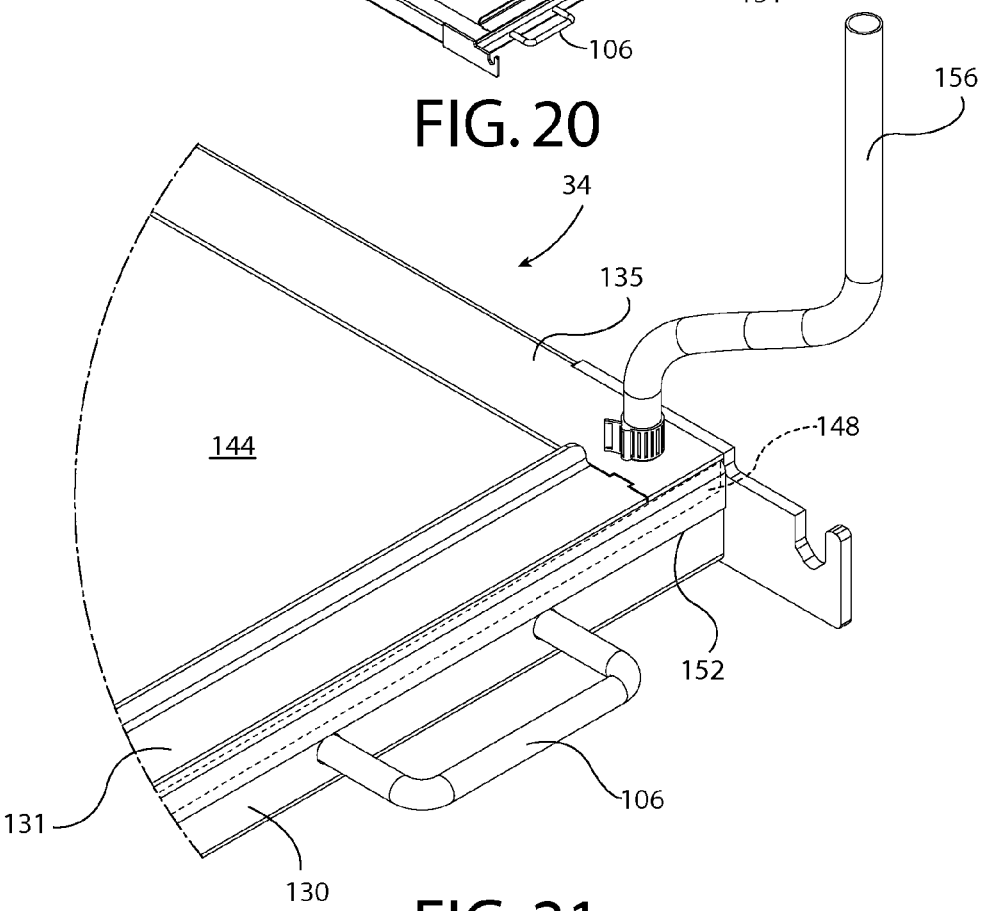
FIG. 21 is a detail view of a corner of the shelf from FIG. 20.

FIG. 20 is a perspective bottom view of a shelf 34, with one area selected for detail. FIG. 21 is a detail of one corner of the bottom of the shelf 34. The shelf plate 144 is slid into place through a slot 148 in one of the shelf walls, in this embodiment, shelf wall 130, see FIG. 21. The plate 144 may have a lip 152 that is generally orthogonal to the plate 144, and acts as a stop when the plate is slid through the slot 148, see FIG. 21. The shelf may have several tie down bars 106.

Figure 22:
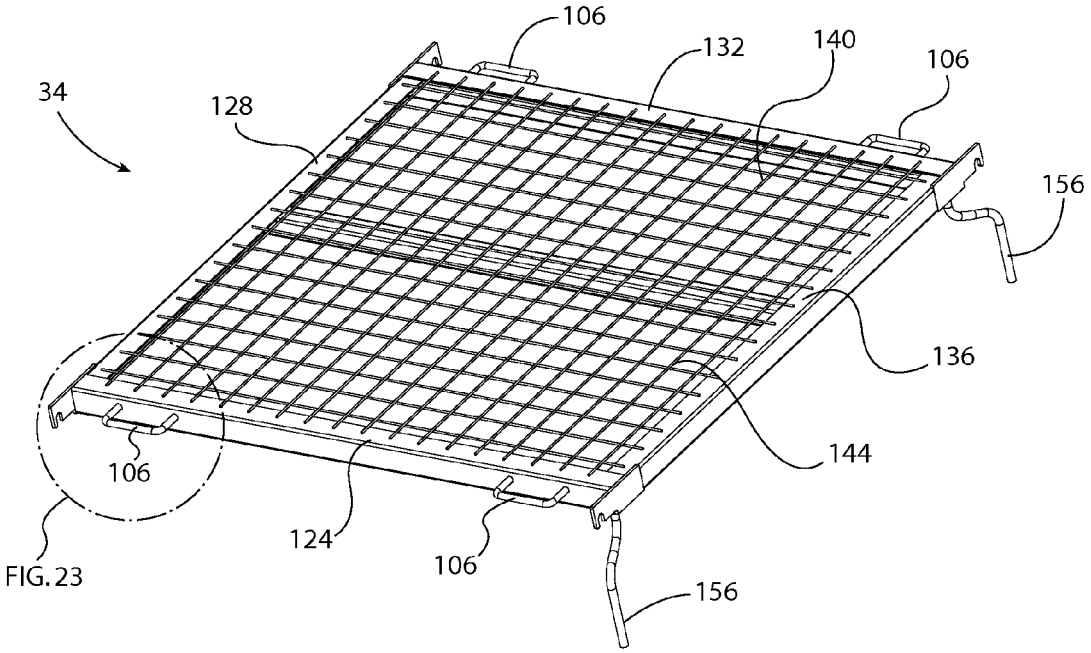
FIG. 22 is a top perspective of a shelf.
Figure 23:
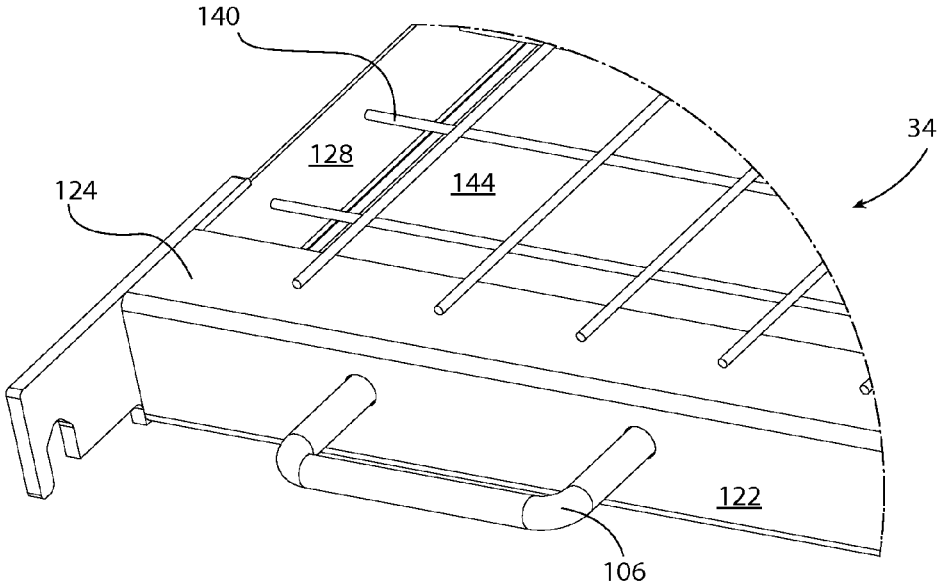
FIG. 23 is a detail view of a tie down bar from FIG. 22.

FIG. 22 is a top perspective view of a shelf 34, with a portion selected for detail. In this view it can be seen how the grating 140 is attached to the top lips 124, 128, 132, 136. FIG. 23 is a detail view of one corner of the shelf 34. On wall 122, one can see there is no slot 148; the slot is on the opposite wall 130.

FIG. 24 is a top view of the container 10. In this embodiment, two shelves 34 span the length of the container 10. FIG. 25 is a cross-sectional view of the container 10 from FIG. 24, with two areas selected for detail. As can also be seen in this figure, this embodiment of the container 10 has 3 shelves 34 on the left side of the container 10, and 3 shelves 34 on the right side of the container 10. FIG. 26 is a close-up view showing how the hose 156 is fed into a shelf drain hole 160 located in an adjacent post, in this view post 22. FIG. 27 is a close-up view of a shelf 34, with its drain hose 156 fed into a shelf drain hole 160 located in post 18. Each of the shelves 34 in the container 10, has its drain hoses 156 feeding into shelf drain holes 160 located in adjacent corner posts 14, 18, 22, 26.

Figure 30:
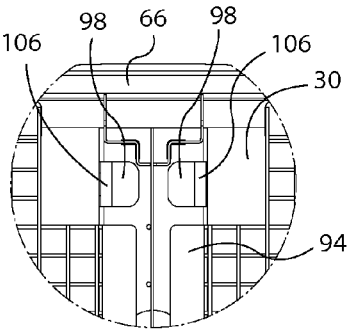
FIG. 30 is a detail view of the midbeam and rear floor beam from FIG. 29.
Figure 31:
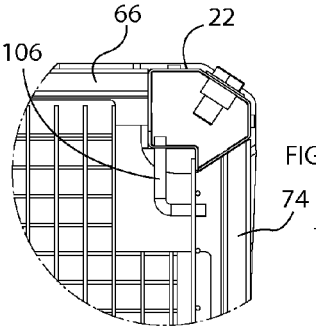
FIG. 31 is a detail view of the floor and a corner post from FIG. 29.
Figure 28:
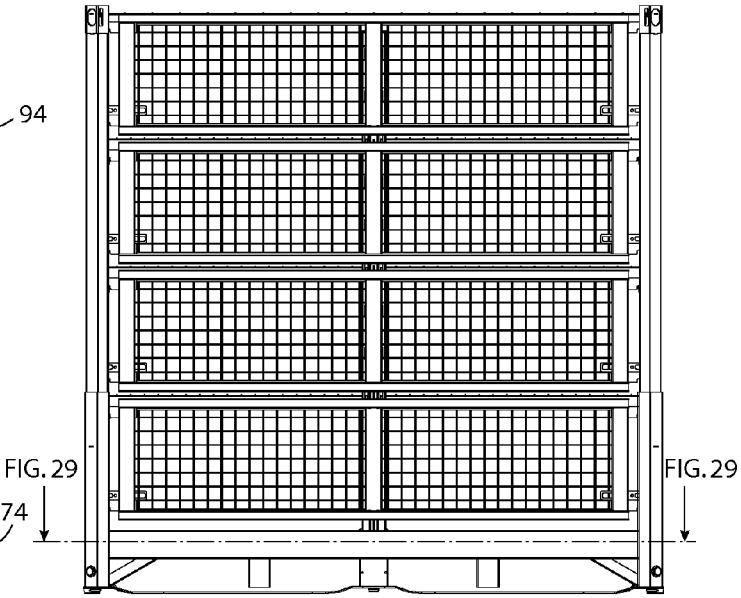
FIG. 28 is a front view of a spill containment intermodal container.
Figure 32:
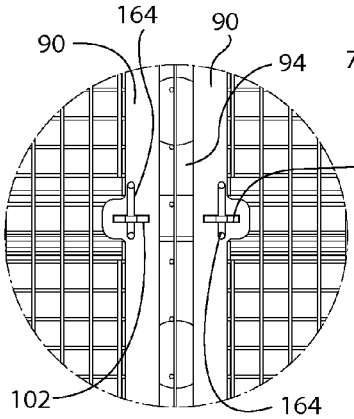
FIG. 32 is a detail view of the midbeam and vertical tabs from FIG. 29.
Figure 29:
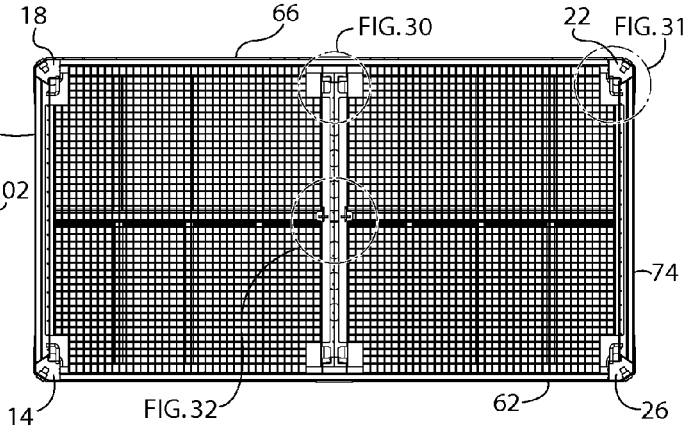
FIG. 29 is a cross-sectional view of the container from FIG. 28.

FIG. 28 is a front view of a container 10. FIG. 29 is a cross-sectional view of the container 10 from FIG. 28, with certain areas selected for detail. FIG. 30 is a detail of the floor 30 of the container near the midbeam 94 and rear floor beam 66. The tie down openings 98 and tie down bars 106 are shown in this view. FIG. 31 is a detail version of a corner of the floor 30 adjacent to post 22. A tie down bar 106 is shown in this view. FIG. 32 is a detail view of the midbeam 94. Tabs 102 are shown extending up through the grating 90. The tabs 102 have holes for a locking pin 164 or locking ring to slide through and keep the grating 90 locked in place with respect to the tabs 102.

Figure 33:
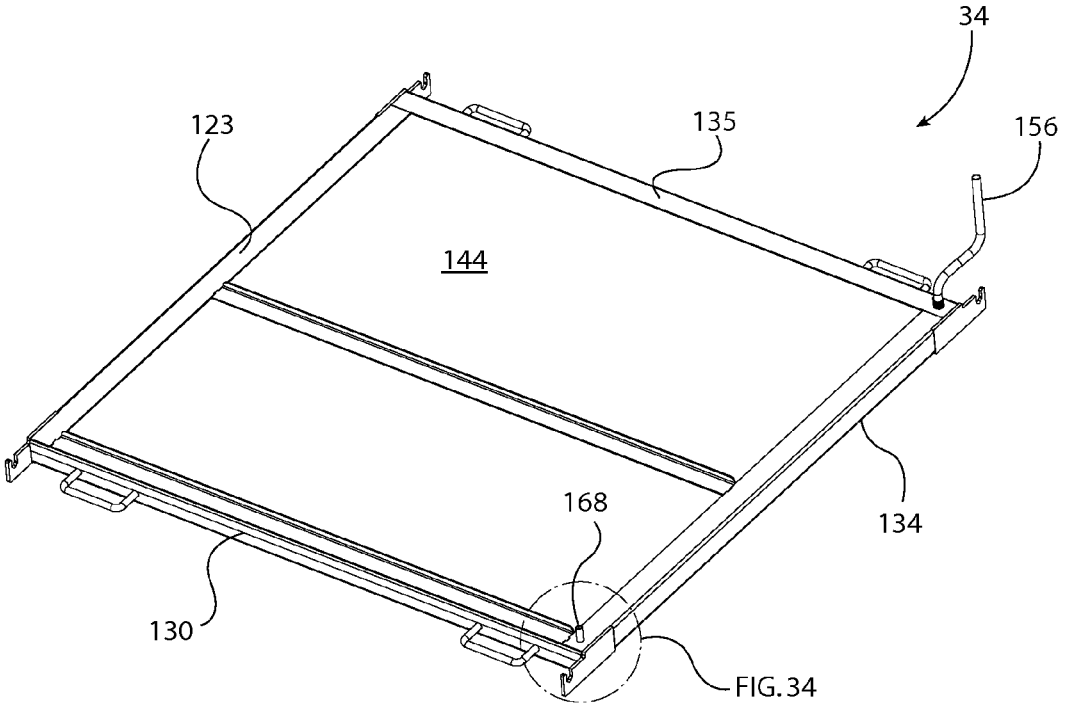
FIG. 33 is a perspective view of a bottom of a shelf.
Figure 34:
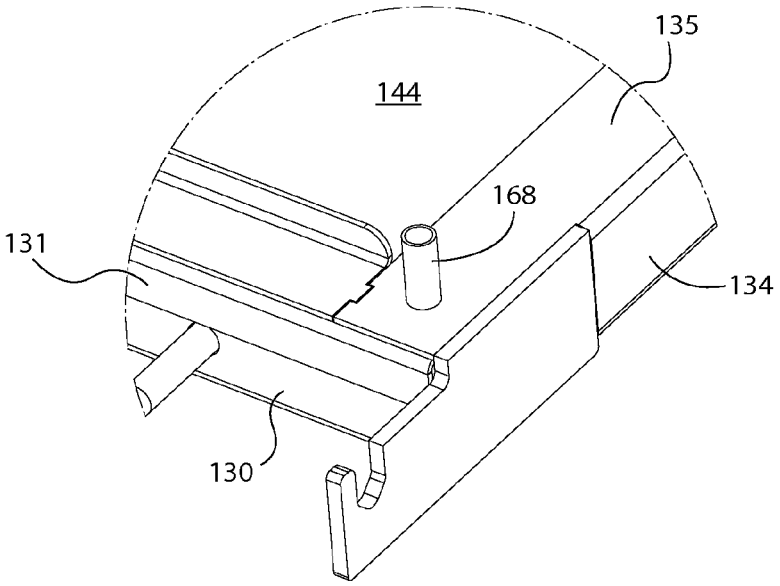
FIG. 34 is a detail view of a drain pipe from FIG. 33.

FIG. 33 is perspective view of an underside of a shelf 34, with a portion selected for detail. FIG. 34 shows a detail of the drain pipe 168 extending from the bottom lip 135. The drain pipe is in fluid communication with the shelf container formed by the plate 144 and the shelf walls 122, 126, 130, 134. The drain pipe 168 is attached to a drain hose 156 which is then fed into a shelf drain hole 160.

Keeping weight down of these containers is very important. In one weight saving embodiment, the floor plate(s) and shelf plate(s) may be made of a different material from the rest of the container. In one embodiment, the container; except for the floor plate 78, 79, 80, and shelf plates 144; may be made of steel which is then hot dipped galvanized. Other materials the container, other than the floor plates and shelf plates, that the container may be made out if include but are not limited to: steel, aluminum, glass fiber composites, carbon fiber composites. Once the container, except for the floor and shelf plates, is hot dipped galvanized, the plates can be attached to the container. However, since the main portion of the container has been hot dipped galvanized, welding is no longer suitable, thus the plates can be attached by any suitable means except for welding. Such attachments means including using adhesives, such as but not limited to: double sided tape, epoxy, glue, sealants, etc. The floor and shelf plates 78, 79, 80, 144, may be made out any suitable light weight material, other than steel, in this embodiment. Such materials include but are not limited to: anodized aluminum, Lexan, aluminum, plastic, high strength pre-galvanized steel, pre-galvanized steel, glass fiber composites, and carbon fiber composits.

The floor container may be configured to hold more than about 110% of the capacity of the largest item being shipped. Thus, if the spill resistant intermodal container 10 is configured to a plurality of 55 gallon drums, the floor container will be sized so that it can hold about 60.5 gallons. In another embodiment, the spill resistant intermodal container 10 may be configured to only have a floor and no shelves. In such an embodiment, the container 10 may have front, side, and rear walls, and top shelf (which is actually a top surface of the container, that protects the contents inside the container). The container 10 can be sized according to the needs of the end of user. The containers 10 can be of any suitable desired size, but in one embodiment they may range from about 31 inches wide, about 47 inches long, and about 40 inches tall to about 50 inches wide, about 110 inches long, and about 90 inches tall.

This invention has many advantages. The container can contain spills of at least 110% of the largest item being transported or stored on the container. The container is stackable. The container has tie down bars and openings for securing items being stored or transported in the container. Each shelf is able to collect spilled fluid and via shelf containers and shelf drain pipes and drain hoses, allow the spilled fluid to remain in the container and travel down on or more posts to the floor container. The floor container has at least on outlet drain hole that can be used to drain spilled fluids out of the intermodal container when the intermodal container is located in a suitable place to remove the spilled fluid. The weight of the intermodal container is kept relatively low due to the use of aluminum or Lexan shelf and floor plates. The disclosed container is transportable, especially when storing items. The disclosed container is collapsible and can be flat packed. When flat packed, the container may be reduced in height to about ⅓ the height of the container when fully assembled.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. An intermodal container comprising:
a first post;
a second post;
a third post;
a fourth post;
a floor drain hole located in one of the posts;
an outlet drain hole located in one of the posts;
a floor attached to the first, second, third, and fourth posts, the floor comprising:
a front floor beam;
a first side floor beam;
a second side floor beam;
a rear floor beam;
a floor grating permanently attached to the top surface of at least two of the floor beams;
at least one floor plate permanently attached to the bottom sides of the front, first side, second side, and rear floor beams, the beams and at least one floor plate forming a floor container, and the floor drain hole in fluid communication with the floor container, and generally at the same elevation as the interior of the floor container, and the outlet drain hole located at an elevation below the floor drain hole and the floor container, the floor container in fluid communication with the interior of the post with the floor drain hole and also in fluid communication with the interior of the post with the outlet drain hole;
a shelf drain hole located in one of the posts;
at least one shelf removeably attachable to the first, second, third and fourth posts, the shelf comprising:
a front shelf wall;
a front shelf bottom lip generally orthogonal to the front shelf wall;
a plate slot located between the front shelf wall and the front shelf bottom lip that extends across generally the entire length of the front shelf wall, and is adjacent to the front shelf bottom lip;
a first side shelf wall attached to the front shelf wall and generally orthogonal to the front shelf wall;
a first side shelf bottom lip generally orthogonal to the first side shelf wall and attached to the first side shelf bottom lip;
a rear shelf wall attached to the front shelf wall and generally orthogonal to the first side shelf wall;
a rear shelf bottom lip generally orthogonal to the rear shelf wall and attached to the rear shelf wall;
a second side shelf wall attached to the front shelf wall and rear shelf wall, and generally orthogonal to both the front shelf wall and rear shelf wall;
a second side shelf bottom lip generally orthogonal to the second side shelf wall and attached to the second side shelf bottom lip;
a shelf grating permanently attached to the shelf walls, and generally parallel to the shelf bottom lips;
a shelf plate configured to slide into the plate slot, and the shelf plate supported and permanently attached to the front shelf bottom lip, first side shelf bottom lip, second side shelf bottom lip, and rear shelf bottom lip, the plate, shelf walls, and shelf bottom lips forming a shelf container;
an outlet pipe attached to one of the shelf bottom lips, the outlet pipe in fluid communication with the shelf container;

a hose attached to the outlet pipe, and inserted into the shelf drain hole, thereby making the shelf container in fluid communication with the interior of the post with the shelf drain hole; and wherein the floor container is fluid communication with the shelf container.

2. The intermodal container of claim 1, wherein the container, except for the floor plate and the shelf plate, is made out of a steel that has been hot dipped galvanized, and the floor plate and shelf plate are made out of the material selected from the group consisting of: Lexan and anodized aluminum.

3. The intermodal container of claim 1, wherein the floor plate and shelf plate are attached to the container by an adhesive.

4. The intermodal container of claim 1, further comprising:

at least one tie down bar extending form the front shelf wall;

at least one tie down bar extending from the rear shelf wall.

5. The intermodal container of claim 1, further comprising:

a shelf plate lip extending orthogonally form the shelf plate.

6. The intermodal container comprising:

a first post;

a second post;

a third post;

a fourth post;

a floor drain hole located in one of the post;

an outlet drain hole located in one of the post;

a floor attached to the first, second, third and fourth posts, the floor comprising:

a front floor beam;

a first side floor beam;

a second side floor beam;

a rear floor beam;

a floor grating permanently attached to the top surface of at least two of the floor beams;

at least one floor plate permanently attached to the bottom sides of the front, first side, second side, and rear floor beams, the beams and at least one floor plate forming a floor container, and the floor drain hole in fluid communication with the floor container, and generally at the same elevation as the interior of the floor container, and the outlet drain hole located at an elevation below the floor drain hole and the floor container, the floor container in fluid communication with the interior of the post with the floor drain hole and also in fluid communication with the interior of the post with the outlet drain hole;

a shelf drain hole located in one of the posts;

at least one shelf removeably attachable to two of the posts selected from the group consisting of the first, second, third and fourth posts, the shelf comprising:

a front shelf wall;

a front shelf bottom lip generally orthogonal to the front shelf wall;

a plate slot located between the front shelf wall and the front shelf bottom lip that extends across generally the entire length of the front shelf wall, and is adjacent to the front shelf bottom lip;

a first side shelf wall attached to the front shelf wall and generally orthogonal to the front shelf wall;

a first side shelf bottom lip generally orthogonal to the first side shelf wall and attached to the first side shelf bottom lip;

a rear shelf wall attached to the front shelf wall and generally orthogonal to the first side shelf wall;

a rear shelf bottom lip generally orthogonal to the rear shelf wall and attached to the rear shelf wall;

a second side shelf wall attached to the front shelf wall and rear shelf wall, and generally orthogonal to both the front shelf wall and rear shelf wall;

a second side shelf bottom lip generally orthogonal to the second side shelf wall and attached to the second side shelf bottom lip;

a shelf grating permanently attached to the shelf walls, and generally parallel to the shelf bottom lips;

a shelf plate configured to slide into the plate slot, and the shelf plate supported and permanently attached to the front shelf bottom lip, first side shelf bottom lip, second side shelf bottom lip, and rear shelf bottom lip, the plate, shelf walls, and shelf bottom lips forming a shelf container;

an outlet pipe attached to one of the shelf bottom lips, the outlet pipe in fluid communication with the shelf container;

a hose attached to the outlet pipe, and inserted into the shelf drain hole, thereby making the shelf container in fluid communication with the interior of the post with the shelf drain hole; and wherein the floor container is fluid communication with the shelf container.

7. The intermodal container of claim 6, wherein the container, except for the floor plate and the shelf plate, is made out of a steel that has been hot dipped galvanized, and the floor plate and shelf plate are made out of the material selected from the group consisting of: Lexan and anodized aluminum.

8. The intermodal container of claim 6, wherein the floor plate and shelf plate are attached to the container by an adhesive.

9. The intermodal container of claim 6, further comprising:

at least one tie down bar extending form the front shelf wall;

at least one tie down bar extending from the rear shelf wall.

10. The intermodal container of claim 6, further comprising:

a shelf plate lip extending orthogonally form the shelf plate.

* * * * *